US010682693B2

(12) United States Patent
Ren et al.

(10) Patent No.: US 10,682,693 B2
(45) Date of Patent: Jun. 16, 2020

(54) METHOD AND APPARATUS FOR CONTINUOUS SEMISOLID DIE CASTING

(71) Applicant: ZHUHAI RUNXINGTAI ELECTRICAL CO., LTD., Zhuhai (CN)

(72) Inventors: Huaide Ren, Zhuhai (CN); Ying Zhang, Zhuhai (CN); Jicheng Wang, Zhuhai (CN); Gunan Li, Zhuhai (CN)

(73) Assignee: ZHUHAI RUNXINGTAI ELECTRICAL CO., LTD., Zhuhai (CN)

( * ) Notice: Subject to any disclaimer, the term of this patent is extended or adjusted under 35 U.S.C. 154(b) by 275 days.

(21) Appl. No.: 15/874,858

(22) Filed: Jan. 18, 2018

(65) Prior Publication Data

US 2018/0141113 A1 May 24, 2018

Related U.S. Application Data

(63) Continuation-in-part of application No. PCT/CN2017/077539, filed on Mar. 21, 2017.

(30) Foreign Application Priority Data

Apr. 8, 2016 (CN) ..... 2016 1 0216958

(51) Int. Cl.
*B22D 17/00* (2006.01)
*B22D 17/32* (2006.01)
(Continued)

(52) U.S. Cl.
CPC ..... *B22D 17/32* (2013.01); *B22D 1/00* (2013.01); *B22D 17/00* (2013.01); *B22D 17/007* (2013.01); *B22D 21/04* (2013.01); *C22B 9/103* (2013.01)

(58) Field of Classification Search
CPC ..... B22D 17/007
See application file for complete search history.

(56) References Cited

U.S. PATENT DOCUMENTS 6,165,411 A 12/2000 Adachi et al.
7,509,993 B1 * 3/2009 Turng ..... B82Y 30/00 164/97
(Continued)

FOREIGN PATENT DOCUMENTS

CN 1994622 A 7/2007
CN 101708543 B 11/2011
(Continued)

OTHER PUBLICATIONS

The World Intellectual Property Organization (WIPO) International Search Report for PCT/CN2017/077539 dated May 26, 2017 2 Pages.

*Primary Examiner* — Kevin E Yoon
(74) *Attorney, Agent, or Firm* — Anova Law Group, PLLC

(57) ABSTRACT

A method for continuous semisolid die casting. The method is achieved using an apparatus for continuous semisolid die casting. The apparatus includes: a first preparation device for producing a nucleating agent, a second preparation device for producing semisolid slurry, a semisolid die casting machine, and a central controller. The second preparation device includes a slurry generator. The method includes: controlling, by the central controller, the first preparation device to produce a solid nucleating agent, and delivering the solid nucleating agent to the slurry generator of the second preparation device; controlling, by the central controller, the second preparation device to produce semisolid slurry, and delivering the semisolid slurry to the semisolid die casting machine; and controlling, by the central control-
(Continued)

ler, the semisolid die casting machine to perform semisolid die casting.

7 Claims, 3 Drawing Sheets

(51) Int. Cl.
*B22D 21/04* (2006.01)
*C22B 9/10* (2006.01)
*B22D 1/00* (2006.01)

(56) References Cited

U.S. PATENT DOCUMENTS

| | | | | |
|---|---|---|---|---|
| 2005/0056394 | A1* | 3/2005 | Kamm | B22D 17/007 164/113 |
| 2005/0126737 | A1* | 6/2005 | Yurko | B22D 17/007 164/113 |
| 2007/0079949 | A1* | 4/2007 | Ivanchev | B22D 17/2023 164/113 |

FOREIGN PATENT DOCUMENTS

| | | | |
|---|---|---|---|
| CN | 103173638 | A | 6/2013 |
| CN | 203683638 | U | 7/2014 |
| CN | 104259417 | A | 1/2015 |
| CN | 104259418 | A | 1/2015 |
| CN | 204122726 | U | 1/2015 |
| CN | 204122727 | U | 1/2015 |
| CN | 104988343 | A | 10/2015 |
| CN | 105127393 | A | 12/2015 |
| CN | 204898039 | U | 12/2015 |
| CN | 105268933 | A | 1/2016 |
| CN | 105331909 | A | 2/2016 |
| CN | 105855496 | A | 8/2016 |
| EP | 0745694 | A1 | 12/1996 |
| JP | 2006525123 | A | 11/2006 |
| JP | 2008522831 | A | 7/2008 |
| JP | 2011147955 | A | 8/2011 |

* cited by examiner

METHOD AND APPARATUS FOR CONTINUOUS SEMISOLID DIE CASTING

CROSS-REFERENCE TO RELATED APPLICATIONS

This application is a continuation-in-part of International Patent Application No. PCT/CN2017/077539 with an international filing date of Mar. 21, 2017, designating the United States, now pending, and further claims foreign priority benefits to Chinese Patent Application No. 201610216958.3 filed Apr. 8, 2016. The contents of all of the aforementioned applications, including any intervening amendments thereto, are incorporated herein by reference.

BACKGROUND OF THE INVENTION

Field of the Invention

The invention relates to a method and apparatus for continuous semisolid die casting.

Description of the Related Art

Existing semisolid die casting methods include mechanical stirring, electromagnetic stirring, controlled solidification, strain activation, and powder metallurgy. These methods are disadvantageous for the following reasons: (1) the slurry preparation device is complex and costly, (2) the solid to liquid ratio in the semisolid slurry is difficult to control, and (3) the solid content of the slurry is unstable. In addition, the processes are inefficient, and the semisolid slurry prepared by the processes includes coarse, large globular grains and low degree of roundness.

SUMMARY OF THE INVENTION

In view of the above-described problems, one objective of the disclosure is to provide a method and apparatus for continuous semisolid die casting that are efficient and stable when preparing semisolid slurry.

To achieve the above objectives, in accordance with one embodiment of the invention, there is provided a method for continuous semisolid die casting, the method being achieved using an apparatus for continuous semisolid die casting, the apparatus comprising: a first preparation device for producing a nucleating agent, a second preparation device for producing semisolid slurry, a semisolid die casting machine, and a central controller, the second preparation device comprising a slurry generator, and the method comprising:

- controlling, by the central controller, the first preparation device to produce a solid nucleating agent, and delivering the solid nucleating agent to the slurry generator of the second preparation device;
- controlling, by the central controller, the second preparation device to produce semisolid slurry, and delivering the semisolid slurry to the semisolid die casting machine; and
- controlling, by the central controller, the semisolid die casting machine to perform semisolid die casting.

In a class of this embodiment, the first preparation device comprises a resistance furnace and a sealed cap, and, controlling, by the central controller, the first preparation device to produce a solid nucleating agent, and delivering the solid nucleating agent to the slurry generator of the second preparation device comprises:

- putting spindles of the nucleating agent into the resistance furnace of the first preparation device;
- locking the sealed cap of the first preparation device;
- heating the resistance furnace to melt the spindles of the nucleating agent into a liquid nucleating agent with a preset temperature;
- heating a metal mold to a first preset temperature;
- closing the metal mold, and injecting the liquid nucleating agent into the metal mold;
- allowing the generation of the solid nucleating agent, and opening the metal mold; and
- delivering the produced solid nucleating agent to the second preparation device for producing semisolid slurry.

Specifically, the preset temperature of the liquid nucleating agent is 650-700 degrees Celsius, and the first preset temperature of the metal mold is 180-240 degrees Celsius.

In a class of this embodiment, a mass of the solid nucleating agent transmitted to the slurry generator of the second preparation device accounts for 0.5-1.5% of that of the liquid slurry.

In a class of this embodiment, the mass of the solid nucleating agent transmitted to the slurry generator of the second preparation device accounts for 1% of that of the liquid slurry.

In a class of this embodiment, the solid nucleating agent is hollow hemispherical particles, and a mass of each particle is 10-20 g.

In a class of this embodiment, the second preparation device further comprises a gas cooling mechanical stirrer, the gas cooling mechanical stirrer comprises a hollow stirring rod equipped with a temperature measuring apparatus, and, controlling the second preparation device to produce semisolid slurry comprises:

- controlling the gas cooling mechanical stirrer to stir in the slurry generator at a preset rotate speed for a preset time period;
- obtaining a temperature of semisolid slurry by the temperature measuring apparatus of the hollow stirring rod; and
- controlling a temperature of the slurry generator so that the temperature of the semisolid slurry holds at a second preset temperature.

Specifically, the preset rotate speed is 200-1000 revolutions/second, the preset time period is 10-25 second, and the second preset temperature is 595-605 degrees Celsius.

In a class of this embodiment, the preset rotate speed is 800 revolutions/second, the preset time period is 20 second, the second preset temperature is 605 degrees Celsius.

According to another aspect of the disclosure, the disclosure also provides an apparatus for continuous semisolid die casting, the apparatus comprising: a first preparation device for producing nucleating agent, a second preparation device for producing semisolid slurry, a semisolid die casting machine, and a central controller; the central controller is adapted to:

- control the first preparation device to produce a solid nucleating agent and deliver the solid nucleating agent to the slurry generator of the second preparation device;
- control the second preparation device to produce semisolid slurry and deliver the semisolid slurry to the semisolid die casting machine; and
- control the semisolid die casting machine to perform semisolid die casting.

In a class of this embodiment, the first preparation device for producing nucleating agent comprises a resistance furnace, a sealed cap, a lift tube, a metal mold, a hydraulic equipment, and a delivering equipment for delivering solid nucleating agent; the central controller is adapted to control the first preparation device to produce the solid nucleating agent and deliver the solid nucleating agent as follows:

putting spindles of the nucleating agent into the resistance furnace of the first preparation device;

locking the sealed cap of the first preparation device;

heating the resistance furnace to melt the spindles of the nucleating agent into a liquid nucleating agent with a preset temperature;

heating a metal mold to a first preset temperature;

closing the metal mold, and injecting the liquid nucleating agent into the metal mold; and allowing the generation of the solid nucleating agent, and opening the metal mold; and delivering the produced solid nucleating agent to the second preparation device for producing semisolid slurry.

Specifically, the preset temperature of the liquid nucleating agent is 650-700 degrees Celsius, and the first preset temperature of the metal mold is 180-240 degrees Celsius.

In a class of this embodiment, the second preparation device comprises a gas cooling mechanical stirrer and a slurry generator, the gas cooling mechanical stirrer comprises a hollow stirring rod equipped with a temperature measuring apparatus, and the central controller is adapted to:

control the gas cooling mechanical stirrer to stir in the slurry generator at a preset rotate speed for a preset time period;

control the temperature measuring apparatus of the hollow stirring rod to acquire a temperature of semisolid slurry; and control a temperature of the slurry generator so that the temperature of the semisolid slurry holds at a second preset temperature.

Specifically, the preset rotate speed is 200-1000 revolutions/second, the preset time period is 10-25 second, and the second preset temperature is 595-605 degrees Celsius.

The method and apparatus for continuous semisolid die casting provided in the disclosure have the following advantages:

(1) adding the solid nucleating agent into the liquid slurry, and controlling the addition percentage of the nucleating agent and the relative temperature of the nucleating agent and the liquid slurry, so that the temperature of the liquid slurry can be lowered rapidly, the solid nucleating agent can be melted and decomposed to form a lot of solid nucleation during stirring procedure, therefore the dendrite broken up because of the stirring operation can form refined and uniform globular grain structure, and content of the solid slurry in the produced semisolid slurry can be increased and maintained at about 42-50% all the time. The time required for preparing the slurry is decreased, the content of the solid slurry in the semisolid slurry is increased, and refined and uniform globular grains can be obtained, therefore the problem of the content of solid slurry being low during conditional semisolid slurry preparation is solved, and the efficiency in preparing semisolid slurry is improved, and the quality of the semisolid slurry can remain stable.

(2) The three procedures of solid nucleating agent preparation, semisolid slurry preparation, semisolid slurry die casting can be performed circularly, and the integrated semisolid die casting production device can operate automatically and stably. The semisolid products produced by using the die casting technique have the advantages of stable quality and higher acceptability, therefore, the production cost is decreased. The semisolid production using the die casting process with the integrated device circularly performing the process provides a new semisolid die casting production method, and provides a new idea for the development of semisolid die casting technique.

Figure 1:
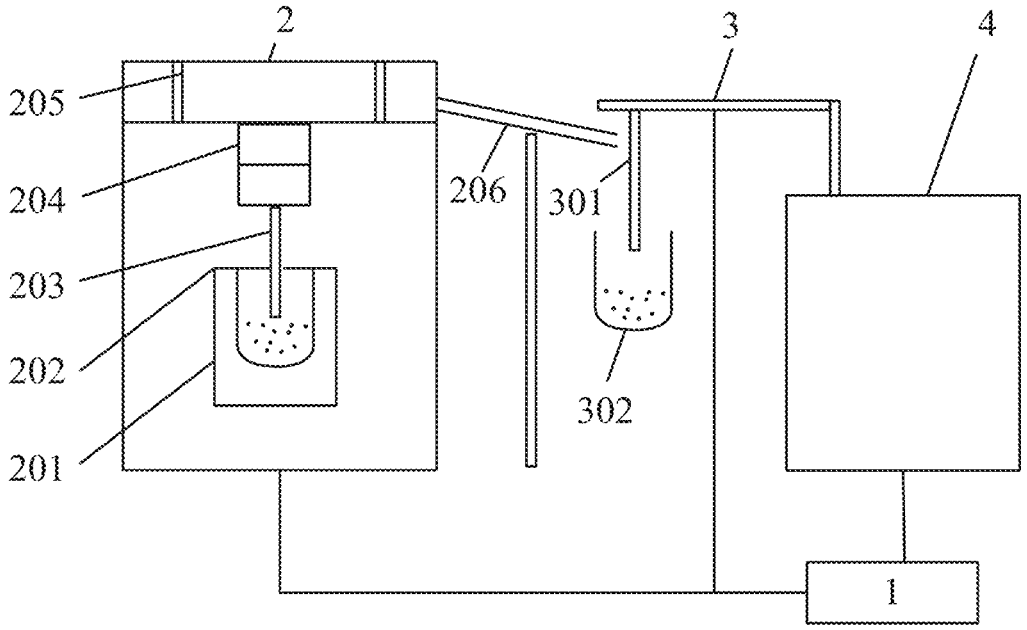
FIG. 1 is a schematic diagram of an apparatus for continuous semisolid die casting of the disclosure.

In the drawings, the flowing reference numbers are used: 1. Central controller; 2. First preparation device for producing nucleating agent; 201. Resistance furnace; 202. Sealed cap; 203. Lift tube; 204. Metal mold; 205. Hydraulic equipment; 206. Delivering equipment for delivering solid nucleating agent; 3. Second preparation device for producing semisolid slurry; 301. Gas cooling mechanical stirrer; 302. Slurry generator; 4. Semisolid die casting machine.

DETAILED DESCRIPTION OF THE EMBODIMENTS

For further illustrating the invention, experiments detailing a method and apparatus for continuous semisolid die casting are described below.

FIG. 1 is a schematic diagram of an apparatus for continuous semisolid die casting, which comprises: a central controller 1, a first preparation device 2 for producing nucleating agent, a second preparation device 3 for producing semisolid slurry, semisolid die casting machine 4, and the first preparation device 2 for producing nucleating agent, the second preparation device 3 for producing semisolid slurry, the semisolid die casting machine 4 are all connected with the central controller 1 through electrical signals. The central controller 1 controls the whole production process, all procedure operations are performed circularly and automatically by means of numerical control program and corresponding induction position switch, so that continuous die casting production can be realized.

The central controller 1 controls the first preparation device 2 to produce solid nucleating agent and deliver the solid nucleating agent to a slurry generator of the second preparation device 3; controls the second preparation device 3 to produce semisolid slurry and deliver the semisolid slurry to the semisolid die casting machine 4; controls the semisolid die casting machine 4 to perform semisolid die casting.

The first preparation device 2 for producing nucleating agent comprises: a resistance furnace 201, a sealed cap 202, a lift tube 203, a metal mold 204, a hydraulic equipment 205, and a delivering equipment 206 for delivering solid nucleating agent. The central controller 1 controls the first preparation device 2 to produce solid nucleating agent and deliver the solid nucleating agent according to the following method: after the nucleating agent spindles are put into the resistance furnace 201, controlling the sealed cap 202 to be locked, controlling the resistance furnace 201 to heat the nucleating agent spindles to liquid nucleating agent with the liquid preset temperature, controlling the metal mold 204 to be heated to the first preset temperature and maintain this temperature, controlling the hydraulic equipment 205 to close the metal mold 204, controlling the lift tube 203 to inject the liquid nucleating agent into the metal mold 204; after the solid nucleating agent is produced, controlling the hydraulic equipment 205 to open the metal mold 204, delivering the solid nucleating agent to the solid nucleating agent transmitting equipment through the delivering equipment 206 for delivering solid nucleating agent; the liquid preset temperature being 650-700 degrees Celsius, the first preset temperature being 180-240 degrees Celsius. The metal mold 204 comprises an upper diaphragm chamber and a lower diaphragm chamber, after the hydraulic equipment 205 being controlled to open the metal mold 204, the upper diaphragm chamber can be transmitted by a screw rod and moved to a slurry preparation area, and the solid nucleating agent can be transmitted to delivering equipment 206 for delivering solid nucleating agent.

The second preparation device 3 comprises: gas cooling mechanical stirrer 301, slurry generator 302, and there is a temperature measuring apparatus provided in a hollow stirring rod. The gas cooling mechanical stirrer 301 comprises the hollow stirring rod with a copper pipe in it. When the stirring rod rotates, the compressed air with a certain flux and pressure will exchange heat with molten aluminum indirectly, to cool the molten aluminum. Preferably, when setting the gas cooling mechanical stirrer, the pressure of cooling air is set to 3.5-4.5 kPa, the flux of the compressed air is set to 10-30 L/min.

The central controller 1 controls the gas cooling mechanical stirrer 301 to stir in the slurry generator at a preset rotate speed for a preset time period. The temperature of the semisolid slurry will be obtained by the temperature measuring apparatus in the hollow stirring rod. The preparation temperature of the slurry generator is controlled so that the temperature of the semisolid slurry holds at a second preset temperature, and the fluctuation range of the second preset temperature is +3 degrees Celsius. The preset rotate speed is 200-1000 revolutions/second, and the preset time period is 10-25 second, the second preset temperature is 595-605 degrees Celsius.

Figure 2:
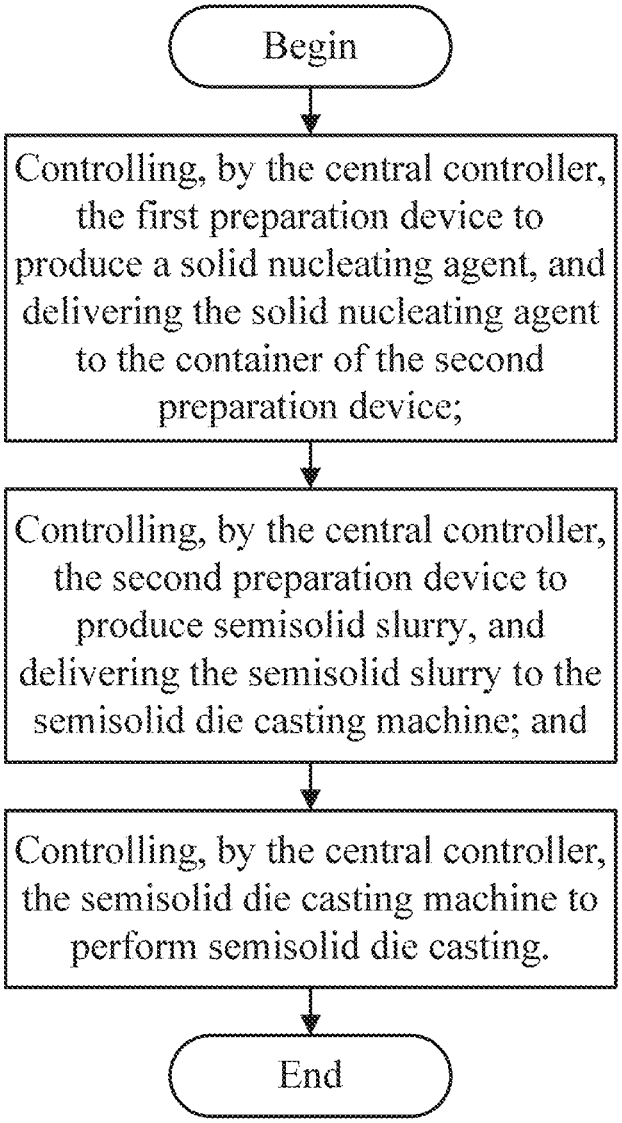
FIG. 2 is a flow chart of a method for continuous semisolid die casting of the disclosure.

FIG. 2 is a flow chart of the semisolid die casting production process. The present method comprises the following steps executed by the central controller:

Step 1, controlling first preparation device for producing nucleating agent to produce solid nucleating agent and to deliver the solid nucleating agent to the slurry generator of the second preparation device for producing semisolid slurry;

Step 2, controlling the second preparation device for producing semisolid slurry to produce semisolid slurry and to deliver the semisolid slurry to the semisolid die casting machine;

Step 3, controlling the semisolid die casting machine to perform die casting.

The present method will be explained in detail.

In step 1, after the nucleating agent spindles are put into the resistance furnace, control the sealed cap to be locked, control the resistance furnace to heat the nucleating agent spindles to liquid nucleating agent with the liquid preset temperature, control the metal mold to be heated to the first preset temperature and maintain this temperature, control the hydraulic equipment to close the metal mold, control the lift tube to inject the liquid nucleating agent into the metal mold; after the solid nucleating agent is produced, control the hydraulic equipment to open the metal mold, delivering the produced solid nucleating agent to the solid nucleating agent transmitting equipment through the delivering equipment for delivering solid nucleating agent (such as launder). Wherein, the liquid preset temperature is 650-700 degrees Celsius, preferably 680 degrees Celsius, the first preset temperature is 180-240 degrees Celsius. The metal mold is heated to 180-240 degrees Celsius and is maintained at this degree Celsius. Under this circumstance, the temperature of the nucleating agent particles can maintain at 80-120 degrees Celsius, so that the hollow hemispherical nucleating agent particles added during slurry preparation can be melted to form solid nucleation easily. The nucleating agent particles with temperature being 80-120 degrees Celsius play a role of fast cooling during slurry preparation.

The mass of solid nucleating agent delivered to the slurry generator of the second preparation device for producing semisolid slurry accounts for 0.2-1.5% of the mass of the liquid slurry. The addition amount of the nucleating agent will influence the roundness of the globular grain and solid content, as illustrated in Table 1.

TABLE 1

Influence of addition amount of solid nucleating agent on roundness of the globular grain and solid content

| Test No. | Addition of nucleating agent/g | Addition percentage/% | Roundness |
|---|---|---|---|
| 1 | 0.5 | 0.68 | 36 |
| 2 | 0.58 | 0.70 | 38 |
| 3 | 0.67 | 0.72 | 39 |
| 4 | 0.75 | 0.76 | 42 |
| 5 | 0.83 | 0.78 | 46 |
| 6 | 0.92 | 0.82 | 50 |
| 7 | 1.0 | 0.88 | 56 |
| 8 | 1.08 | 0.82 | 50 |
| 9 | 1.17 | 0.84 | 48 |
| 10 | 1.25 | 0.83 | 49 |
| 11 | 1.33 | 0.84 | 46 |
| 12 | 1.42 | 0.86 | 44 |
| 13 | 1.5 | 0.85 | 42 |

As can be known from Table 1, the addition percentage of the nucleating agent is in the range of 0.5-1.5%, when the addition amount increases, the globular grains of the semisolid slurry will be more rounding, and the proportion of solid content will increase too. When the addition percentage is above 1%, the proportion of solid content of slurry will decrease, and the roundness will decrease too. Therefore, the preferred addition amount of solid nucleating agent particles is 1% of the amount of the alloy for preparing the slurry.

The solid nucleating agent is hollow hemispherical particles, and the mass of each particle is 10-20 g.

In step 2, the operation of controlling the second preparation device for producing semisolid slurry to produce semisolid slurry comprises: controlling gas cooling mechanical stirrer to stir in the slurry generator at a preset rotate speed for a preset time period; obtaining the temperature of the semisolid slurry by the temperature measuring apparatus in the hollow stirring rod; controlling the preparation temperature of the slurry generator so that the temperature of the semisolid slurry holds at the second preset temperature; the preset rotate speed being 200-1000 revolutions/second, and the preset time period being 10-25 second, the second preset temperature being 595-605 degrees Celsius.

The rotate speed and time period of the stirring rod affect the structure of globular grains and mechanical property, as illustrated in Table 2.

TABLE 2

Influence of stirring speed and stirring time on mechanical property of semisolid production

| Test No. | Molten aluminum temperature/° C. | Stirring speed/ $r \cdot min^{-1}$ | Stirring time period/s | Strength of extension/ mPa | Yield strength/ mPa | Elongation/% |
|---|---|---|---|---|---|---|
| 1 | 685 | 900 | 25 | 225 | 116 | 2.7 |
| 2 | 685 | 800 | 20 | 234 | 119 | 3.7 |
| 3 | 680 | 800 | 25 | 231 | 114 | 3.2 |
| 4 | 680 | 700 | 20 | 229 | 117 | 4.0 |
| 5 | 675 | 700 | 20 | 212 | 122 | 3.0 |
| 6 | 675 | 600 | 15 | 189 | 110 | 2.2 |
| 7 | 670 | 800 | 20 | 254 | 135 | 4.5 |
| 8 | 670 | 700 | 15 | 230 | 117 | 3.6 |
| 9 | 665 | 800 | 20 | 220 | 130 | 3.5 |
| 10 | 665 | 600 | 15 | 215 | 127 | 2.8 |
| 11 | 660 | 800 | 20 | 223 | 115 | 2.9 |
| 12 | 660 | 700 | 15 | 235 | 126 | 3.5 |

As can be known from Table 2, during slurry preparation, the stirring speed and the stirring time of the stirring rod directly influence the mechanical property of the semisolid die casting production. When the temperature of the molten aluminum in the furnace is 670 degrees Celsius, the stirring rod stirs to prepare the slurry, with the following parameters: the rotate speed is 800 revolutions/second for 20 seconds, and the temperature of the semisolid slurry is 605 degrees Celsius. In this circumstance, the performance of the semisolid production by using the semisolid slurry die casting process is better.

As the stirring speed increases, the morphology of the primary solid phase in the semisolid die casting structure will be refined and uniform and the distribution will be more even. The reasons are: (a) the increased stirring speed can facilitate improving the convection intensity of melt in the crucible, the increased convection intensity can facilitate the alloy melt realizing higher degree of supercooling in same time period, therefore nucleus can be formed more easily, at the same time, the increased convection intensity can facilitate the distribution of the interior temperature field and concentration field in the undercooling alloy melt being more even; (b) when the stirring speed is relatively low, the times and the intensities of the impacts between the dendrites and the stirring blades, between the dendrites and the cylinder wall, between the dendrites and the dendrites are not high enough, therefore only part of the dendrites are broken up. As the stirring speed increases, the intensities and frequencies of the impacts will increase enormously, which are benefit for breaking off of the dendrite arms, and also benefit for rounding at angle place of granular grain, so that the nearly globular grains can be formed. However, high stirring speed will cause serious air entrapment in the alloy melt and more pore defects in the structure, which are not good for the improvement of the workpiece performance.

Figure 3:
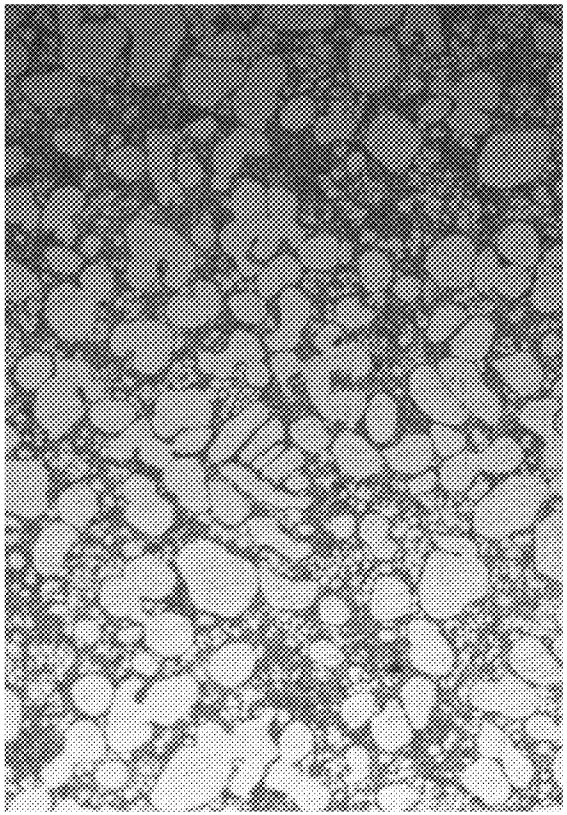
FIG. 3 illustrates metallographic structure of a semisolid slurry produced using the method of the disclosure.

FIG. 3 is the metallographic structure chart of the semisolid slurry produced by using the method of the present method.

The disclosure has the following beneficial effects:

(1) adding the solid nucleating agent into the liquid slurry, and controlling the addition percentage of the nucleating agent and the relative temperature of the nucleating agent and the liquid slurry, so that the temperature of the liquid slurry can be lowered rapidly, the solid nucleating agent can be melted and decomposed to form a lot of solid nucleation during stirring procedure, therefore the dendrite broken up because of the stirring operation can form refined and uniform globular grain structure, and content of the solid slurry in the produced semisolid slurry can be increased and maintained at about 42-50% all the time. The time required for preparing the slurry is decreased, the content of the solid slurry in the semisolid slurry is increased, and refined and uniform globular grains can be obtained, therefore the problem of the content of solid slurry being low during conditional semisolid slurry preparation is solved, and the efficiency in preparing semisolid slurry is improved, and the quality of the semisolid slurry can remain stable.

(2) The three procedures of solid nucleating agent preparation, semisolid slurry preparation, semisolid slurry die casting can be performed circularly, and the integrated semisolid die casting production device can operate automatically and stably. The semisolid products produced by using the die casting technique have the advantages of stable quality and higher acceptability, therefore, the production cost is decreased. The semisolid production using the die casting process with the integrated device circularly performing the process provides a new semisolid die casting production method, and provides a new idea for the development of semisolid die casting technique.

Finally, what should be made clear is that, in this text, the terms "contain", "comprise" or any other variants are intended to mean "nonexclusively include" so that any process, method, article or equipment that contains a series of factors shall include not only such factors, but also include other factors that are not explicitly listed, or also include intrinsic factors of such process, method, object or equipment. Without more limitations, factors defined by the phrase "contain a . . . " or its variants do not rule out that there are other same factors in the process, method, article or equipment which include said factors.

The semisolid production method using a continuous die casting technique in the disclosure can increase the solid content of the slurry, provide refined and uniform globular grains, solve the problem of the solid content being low during traditional semisolid slurry preparation, therefore, the efficiency in preparing semisolid slurry is improved and the quality of semisolid slurry can remain stable. In the apparatus, the three procedures of solid nucleating agent preparation, semisolid slurry preparation, semisolid slurry die casting can be performed circularly, and the integrated semisolid die casting production device can operate automatically and stably. The semisolid products produced by using the die casting technique have the advantages of stable quality and higher acceptability, therefore, the production cost is decreased. The semisolid production using the die casting process with the integrated device circularly performing the process provides a new semisolid die casting production method, and provides a new idea for the development of semisolid die casting technique.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method for continuous semisolid die casting, the method being achieved using an apparatus for continuous semisolid die casting, the apparatus comprising: a first preparation device for producing a nucleating agent, a second preparation device for producing semisolid slurry, a semisolid die casting machine, and a central controller, the second preparation device comprising a slurry generator, and the method comprising:

controlling, by the central controller, the first preparation device to produce a solid nucleating agent, and delivering the solid nucleating agent to the slurry generator of the second preparation device;

controlling, by the central controller, the second preparation device to produce semisolid slurry, and delivering the semisolid slurry to the semisolid die casting machine; and controlling, by the central controller, the semisolid die casting machine to perform semisolid die casting; wherein the first preparation device comprises a resistance furnace and a sealed cap, and, controlling, by the central controller, the first preparation device to produce a solid nucleating agent, and delivering the solid nucleating agent to the slurry generator of the second preparation device comprises: putting spindles of the nucleating agent into the resistance furnace of the first preparation device; locking the sealed cap of the first preparation device; heating the resistance furnace to melt the spindles of the nucleating agent into a liquid nucleating agent with a preset temperature; heating a metal mold to a first preset temperature; closing the metal mold, and injecting the liquid nucleating agent into the metal mold; allowing the generation of the solid nucleating agent, and opening the metal mold; and delivering the produced solid nucleating agent to the second preparation device for producing semisolid slurry; wherein the preset temperature of the liquid nucleating agent is 650-700 degrees Celsius, and the first preset temperature of the metal mold is 180-240 degrees Celsius; wherein a mass of the solid nucleating agent transmitted to the slurry generator of the second preparation device accounts for 0.5-1.5% of that of the liquid slurry.

2. The method of claim 1, wherein the mass of the solid nucleating agent transmitted to the slurry generator of the second preparation device accounts for 1% of that of the liquid slurry.

3. The method of claim 1, wherein the solid nucleating agent is hollow hemispherical particles, and a mass of each particle is 10-20 g.

4. The method of claim 1, wherein the second preparation device further comprises a gas cooling mechanical stirrer, the gas cooling mechanical stirrer comprises a hollow stirring rod equipped with a temperature measuring apparatus, and, controlling the second preparation device to produce semisolid slurry comprises:

controlling the gas cooling mechanical stirrer to stir in the slurry generator at a preset rotate speed for a preset time period;

obtaining a temperature of semisolid slurry by the temperature measuring apparatus of the hollow stirring rod; and controlling a temperature of the slurry generator so that the temperature of the semisolid slurry holds at a second preset temperature;

wherein the preset rotate speed is 200-1000 revolutions/second, the preset time period is 10-25 second, and the second preset temperature is 595-605 degrees Celsius.

5. The method of claim 4, wherein the preset rotate speed is 800 revolutions/second, the preset time period is 20 second, and the second preset temperature is 605 degrees Celsius.

6. An apparatus for continuous semisolid die casting, the apparatus comprising:

a first preparation device for a producing nucleating agent;

a second preparation device for producing semisolid slurry, the second preparation device comprising a slurry generator;

a semisolid die casting machine; and a central controller;

wherein:

the central controller is adapted to:

control the first preparation device to produce a solid nucleating agent and deliver the solid nucleating agent to the slurry generator of the second preparation device;

control the second preparation device to produce semisolid slurry and deliver the semisolid slurry to the semisolid die casting machine; and control the semisolid die casting machine to perform semisolid die casting; wherein: the first preparation device comprises a resistance furnace, a sealed cap, a lift tube, a metal mold, a hydraulic equipment, and a delivering equipment for delivering the solid nucleating agent; the central controller is adapted to control the first preparation device to produce the solid nucleating agent and deliver the solid nucleating agent as follows: putting spindles of the nucleating agent into the resistance furnace of the first preparation device; locking the sealed cap of the first preparation device; heating the resistance furnace to melt the spindles of the nucleating agent into a liquid nucleating agent with a preset temperature; heating a metal mold to a first preset temperature; closing the metal mold, and injecting the liquid nucleating agent into the metal mold; allowing the generation of the solid nucleating agent, and opening the metal mold; and delivering the produced solid nucleating agent to the second preparation device for producing semisolid slurry; wherein the preset temperature of the liquid nucleating agent is 650-700 degrees Celsius, and the first preset temperature of the metal mold is 180-240 degrees Celsius.

7. The apparatus of claim 6, wherein:

the second preparation device comprises a gas cooling mechanical stirrer and a slurry generator, the gas cooling mechanical stirrer comprises a hollow stirring rod equipped with a temperature measuring apparatus;

the central controller is adapted to:

control the gas cooling mechanical stirrer to stir in the slurry generator at a preset rotate speed for a preset time period;

control the temperature measuring apparatus of the hollow stirring rod to acquire a temperature of semisolid slurry; and control a temperature of the slurry generator so that the temperature of the semisolid slurry holds at a second preset temperature;

wherein the preset rotate speed is 200-1000 revolutions/second, the preset time period is 10-25 second, and the second preset temperature is 595-605 degrees Celsius.

* * * * *